US005878757A

United States Patent [19]

Hernandez

[11] Patent Number: 5,878,757

[45] Date of Patent: Mar. 9, 1999

[54] CARRYING CASE FOR HAIR STYLING EQUIPMENT

[76] Inventor: Adelaida Hernandez, 1833 W. Iowa, Chicago, Ill. 60622

[21] Appl. No.: 933,620

[22] Filed: Sep. 8, 1997

[51] Int. Cl.[6] ..... A45D 33/20

[52] U.S. Cl. ..... 132/287; 132/312; 132/314; 190/109; 206/349

[58] Field of Search ..... 132/287, 294, 132/300, 312, 314, 315; 150/106, 119; 190/102, 109, 111, 113, 902; 220/521, 215; 206/545, 581, 349

[56] References Cited

U.S. PATENT DOCUMENTS

| | | | |
|---|---|---|---|
| D. 303,024 | 8/1989 | Zall | D28/76 |
| D. 306,918 | 3/1990 | Stillwagon | D28/73 |
| D. 347,942 | 6/1994 | Gilbert et al. | D3/308 |
| 1,752,948 | 4/1930 | Herrmann | 132/315 |
| 1,785,609 | 12/1930 | Baumann | 132/315 |
| 2,168,073 | 8/1939 | Schnider | 132/315 |
| 2,499,254 | 2/1950 | Parker | 206/545 |
| 2,595,089 | 4/1952 | Lifton | 190/109 |
| 2,635,612 | 4/1953 | Dean | 132/80 |
| 2,648,933 | 8/1953 | Brooks et al. | 45/129 |
| 3,483,954 | 12/1969 | Michalski | 190/109 |
| 3,537,552 | 11/1970 | Noble | 132/315 |
| 4,461,332 | 7/1984 | Parkhurst | 132/314 |
| 4,936,463 | 6/1990 | Tiramani | 132/315 |
| 4,960,204 | 10/1990 | Young et al. | 190/111 |
| 5,329,947 | 7/1994 | Shikler | 132/314 |
| 5,577,607 | 11/1996 | Drake et al. | 206/349 |
| 5,595,302 | 1/1997 | Maydwell et al. | 190/109 |
| 5,638,955 | 6/1997 | Calciano | 206/349 |
| 5,662,219 | 9/1997 | Tschudy et al. | 190/102 |

FOREIGN PATENT DOCUMENTS

| | | | |
|---|---|---|---|
| 887861 | 11/1943 | France | 132/314 |
| 1307694 | 9/1962 | France | 132/315 |

*Primary Examiner*—Todd E. Manahan
*Attorney, Agent, or Firm*—Joseph N. Breaux

[57] ABSTRACT

A carrying case for hair styling equipment that includes a clamshell briefcase structure having hingedly connected upper and lower briefcase sections. The lower briefcase section has an open topped cavity formed therein that is sealed when the upper and lower briefcase sections are pivoted together and an open sided tray storage compartment having a side opening in connection with the exterior of the lower briefcase section. The upper briefcase section has an exteriorly positioned cover flap affixable in a closed position by a zipper closure. The cover flap covers a hair dryer insertion opening formed in connection with an L-shaped, thermal fabric lined hair dryer storage compartment formed within the upper briefcase section; an accordion fold upper storage compartment member affixed to an interior surface of the upper briefcase section, the accordion fold upper storage compartment member being foldable out to from an accordion fold compartment, the accordion fold upper storage compartment member including a first plurality of storage pockets formed on a surface thereof; a drop-in, molded, anti-bacterial plastic storage insert sized to drop-in fit into the open topped cavity of the lower briefcase section, the storage insert including a second plurality of storage insert cavities formed therein; and a slide-in, molded, anti-bacterial plastic storage tray that is sized to slide into the side opening of the open sided tray storage compartment, the storage tray having a third plurality of storage tray cavities formed therein.

18 Claims, 2 Drawing Sheets

CARRYING CASE FOR HAIR STYLING EQUIPMENT

TECHNICAL FIELD

The present invention relates to carrying cases and more particularly to a carrying case for carrying hair styling equipment that includes a clamshell briefcase structure having hingedly connected upper and lower briefcase sections, the lower briefcase section having an open topped cavity formed therein that is sealed when the upper and lower briefcase sections are pivoted together and an open sided tray storage compartment having a side opening in connection with the exterior of the lower briefcase section, the upper briefcase section having an exteriorly positioned cover flap affixable in a closed position by a zipper closure, the cover flap covering a hair dryer insertion opening formed in connection with an L-shaped, thermal fabric lined hair dryer storage compartment formed within the upper briefcase section; an accordion fold upper storage compartment member affixed to an interior surface of the upper briefcase section, the accordion fold upper storage compartment member being foldable out to form an accordion fold compartment, the accordion fold upper storage compartment member including a first plurality of storage pockets formed on a surface thereof; a drop-in, molded, anti-bacterial plastic storage insert sized to drop-in fit into the open topped cavity of the lower briefcase section, the storage insert including a second plurality of storage insert cavities formed therein; and a slide-in, molded, anti-bacterial plastic storage tray that is sized to slide into the side opening of the open sided tray storage compartment, the storage tray having a third plurality of storage tray cavities formed therein.

BACKGROUND OF THE INVENTION

Hair styling requires the use of a variety of tools and preparations. Although it is easy to organize and store the large variety of tools and preparations at a fixed location, such as a styling salon, it is difficult to organize and transport the large variety of tools and preparation to a remote site, such as a bride's home or executive's office. It would, therefore, be a benefit to have a carrying case for hair styling equipment that included compartments for conveniently carrying the hairstyling tools and preparations to a remote location. In addition, because it is necessary to transport warm or hot items, such as recently used curling irons and blow dryers, it would be a benefit to have a carrying case that included a thermal fabric lined compartment within which these hair styling tools could be stored immediately after use. In addition, because hairstyling tools can come into intimate contact with a number of customers, it would of course be a benefit to have storage compartments that included an anti-bacterial action for minimizing transfer of harmful bacteria between customers.

SUMMARY OF THE INVENTION

It is thus an object of the invention to provide a carrying case for hair styling equipment.

It is a further object of the invention to provide a carrying case for hair styling equipment that includes a thermal fabric lined compartment within which heat generating hair styling tools, such as blow dryers and curling irons, can be stored immediately after use.

It is a still further object of the invention to provide a carrying case for hair styling equipment that includes storage compartments formed from an anti-bacterial plastic.

It is a further object of the invention to provide a carrying case for hair styling equipment that includes a clamshell briefcase structure having hingedly connected upper and lower briefcase sections, the lower briefcase section having an open topped cavity formed therein that is sealed when the upper and lower briefcase sections are pivoted together and an open sided tray storage compartment having a side opening in connection with the exterior of the lower briefcase section, the upper briefcase section having an exteriorly positioned cover flap affixable in a closed position by a zipper closure, the cover flap covering a hair dryer insertion opening formed in connection with an L-shaped, thermal fabric lined hair dryer storage compartment formed within the upper briefcase section; an accordion fold upper storage compartment member affixed to an interior surface of the upper briefcase section, the accordion fold upper storage compartment member being foldable out to form an accordion fold compartment, the accordion fold upper storage compartment member including a first plurality of storage pockets formed on a surface thereof; a drop-in, molded, anti-bacterial plastic storage insert sized to drop-in fit into the open topped cavity of the lower briefcase section, the storage insert including a second plurality of storage insert cavities formed therein; and a slide-in, molded, anti-bacterial plastic storage tray that is sized to slide into the side opening of the open sided tray storage compartment, the storage tray having a third plurality of storage tray cavities formed therein.

It is a still further object of the invention to provide a carrying case for hair styling equipment that accomplishes some or all of the above objects in combination.

Accordingly, a carrying case for hair styling equipment is provided. The carrying case includes a clamshell briefcase structure having hingedly connected upper and lower briefcase sections, the lower briefcase section having an open topped cavity formed therein that is sealed when the upper and lower briefcase sections are pivoted together and an open sided tray storage compartment having a side opening in connection with the exterior of the lower briefcase section, the upper briefcase section having an exteriorly positioned cover flap affixable in a closed position by a zipper closure, the cover flap covering a hair dryer insertion opening formed in connection with an L-shaped, thermal fabric lined hair dryer storage compartment formed within the upper briefcase section; an accordion fold upper storage compartment member affixed to an interior surface of the upper briefcase section, the accordion fold upper storage compartment member being foldable out to form an accordion fold compartment, the accordion fold upper storage compartment member including a first plurality of storage pockets formed on a surface thereof; a drop-in, molded, anti-bacterial plastic storage insert sized to drop-in fit into the open topped cavity of the lower briefcase section, the storage insert including a second plurality of storage insert cavities formed therein; and a slide-in, molded, anti-bacterial plastic storage tray that is sized to slide into the side opening of the open sided tray storage compartment, the storage tray having a third plurality of storage tray cavities formed therein.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF THE EXEMPLARY EMBODIMENT

Figure 1:
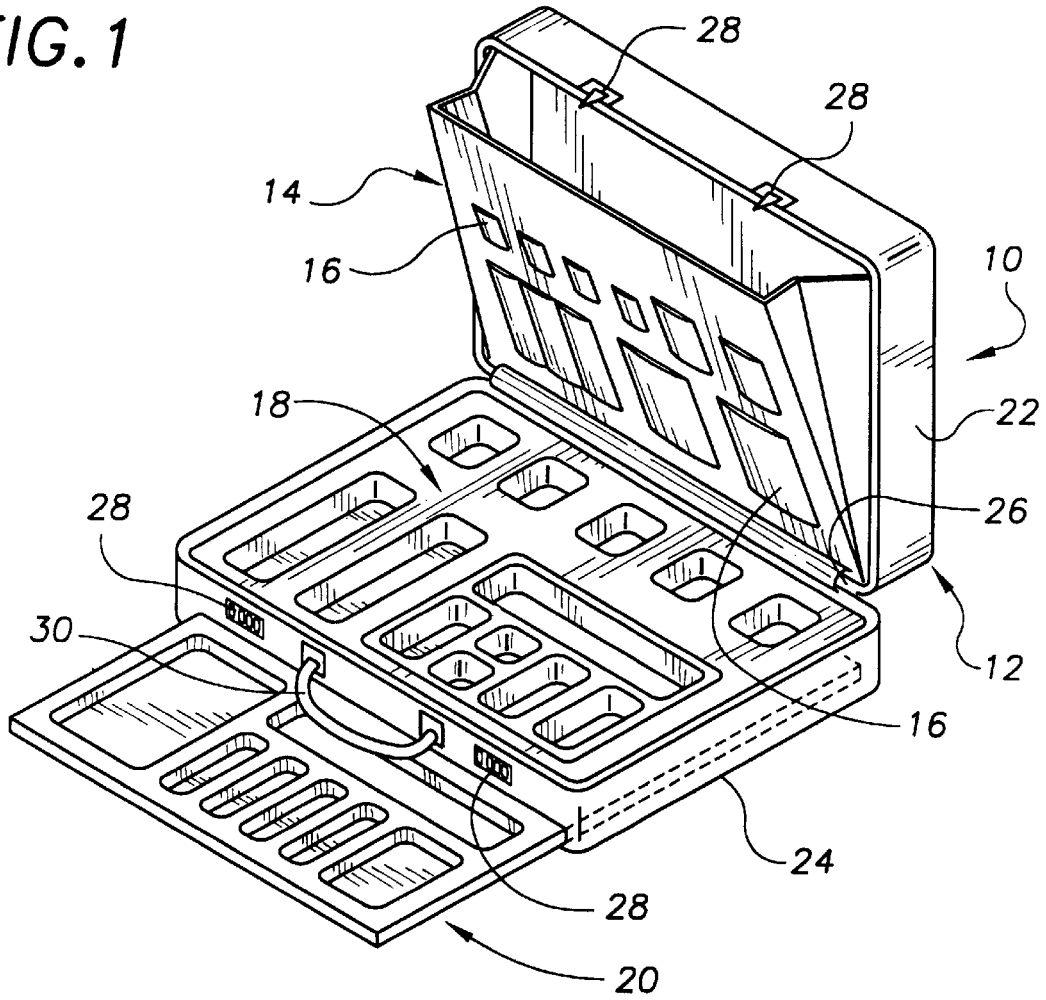
FIG. 1 is a perspective view of an exemplary embodiment of the carrying case for hair styling equipment of the present invention showing the clamshell briefcase structure in the fully open position, the accordion fold upper storage compartment member pulled out to reveal the accordion fold compartment; the small item storage pockets formed on the surface of the accordion fold upper storage compartment member; the drop-in, molded, anti-bacterial plastic storage insert; and the slide-in, molded, anti-bacterial plastic storage tray pulled out of the tray storage compartment.

FIG. 1 shows an exemplary embodiment of the carrying case for hair styling equipment of the present invention generally designated by the numeral 10. In this embodiment, carrying case 10 includes a clamshell briefcase structure, generally designated 12; an accordion fold upper storage compartment member, generally designated 14; a number of small item storage pockets 16; a drop-in, molded, anti-bacterial plastic storage insert, generally designated 18; and a slide-in, molded, anti-bacterial plastic storage tray, generally designated 20. Clamshell briefcase structure 12 includes an upper briefcase section 22 that is hingedly connected to a lower briefcase section 24 by a hinge 26. Upper and lower briefcase sections 22,24 are pivotable into a closed position and lockable in the closed position with locking mechanisms 28. A handle 30 is provided on lower briefcase section 24 to ease carrying of clamshell briefcase structure 12. Although upper and lower briefcase sections 22,24 can be of molded plastic construction, in this embodiment, upper and lower briefcase sections 22,24 are of conventional fabric covered frame construction.

Figure 2:
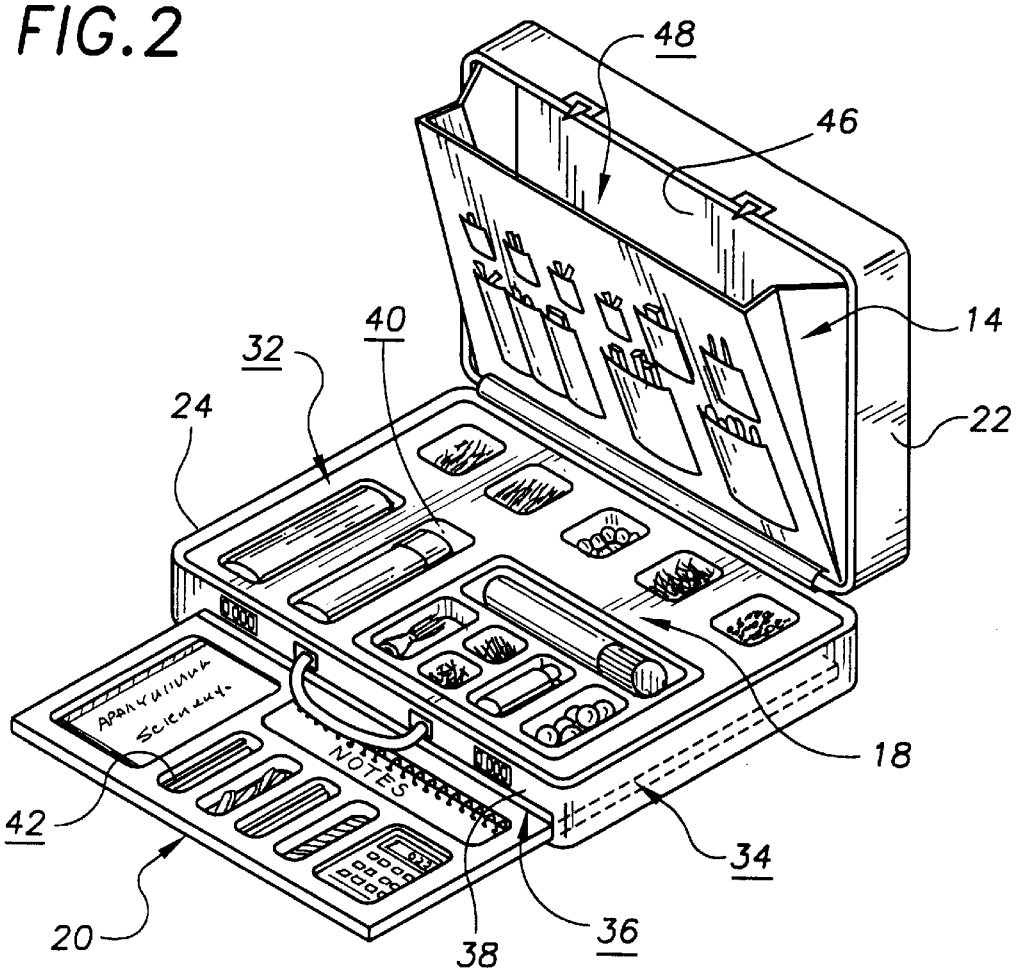
FIG. 2 is a perspective view of the exemplary carrying case for hair styling equipment of FIG. 1 with a variety of hair styling items stored within the accordion fold upper storage compartment; the small item storage pockets; the drop-in, molded, anti-bacterial plastic storage insert; and the slide-in, molded, anti-bacterial plastic storage tray.

With reference to FIG. 2, lower briefcase section 24 has an open topped, rectangular box shaped cavity 32 formed therein that is sealed when upper and lower briefcase sections 22,24 are pivoted together and an open sided tray storage compartment 34 having a side opening 36 in connection with the exterior 38 of lower briefcase section 24. Drop-in, molded, anti-bacterial plastic storage insert 18 is sized to drop-in fit into open topped cavity 32 and includes a number of storage insert cavities 40 for holding items such as clippers, scissors, combs, brushes, etc. Slide-in, molded, anti-bacterial plastic storage tray 20 is sized to slide into side opening 36 of open sided tray storage compartment 34. Storage tray 20 includes a number of storage tray cavities 42 for storing relatively flat or thin items such as appointment books, calculators, eye liner pencils, etc. Storage tray 20 is slidable into tray storage compartment 34 when not needed. Accordion fold upper storage compartment member 14 is adhesively affixed to an interior surface 46 of upper briefcase section 22 and is foldable to form an accordion fold compartment 48 for storing flat items such as example hairstyle photos and receipt books.

Figure 3:
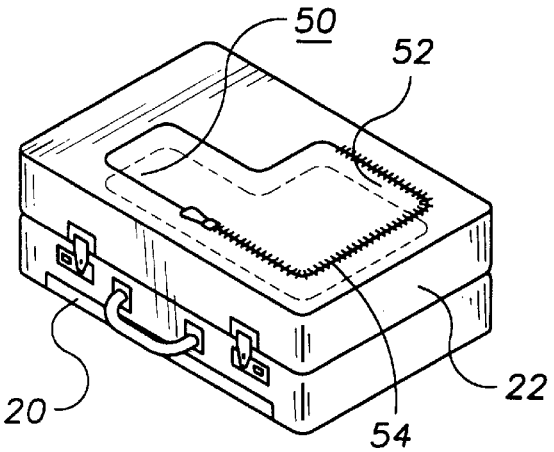
FIG. 3 is a perspective view of the exemplary carrying case for hair styling equipment of FIG. 1 showing the clamshell briefcase structure in the closed position and the slide-in, molded, anti-bacterial plastic storage tray pushed into the tray storage compartment, the exterior of the clamshell briefcase structure having a zipper closure in connection with a cover flap leading to an L-shaped, thermal fabric lined hair dryer storage compartment.
Figure 4:
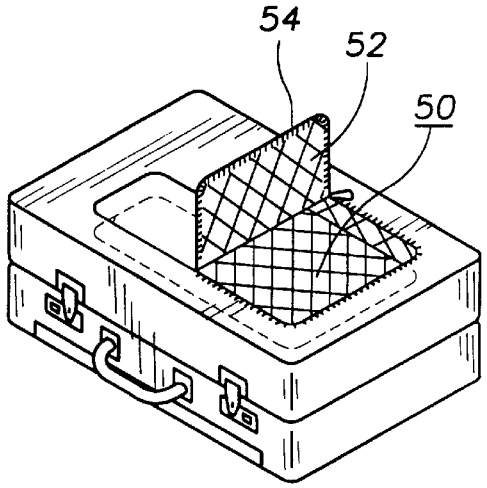
FIG. 4 is a perspective view of the exemplary carrying case for hair styling equipment of FIG. 3 with the clamshell briefcase structure in the closed position and the zipper closure in the open configuration with the cover flap folded up to reveal the opening into the L-shaped, thermal fabric lined hair dryer storage compartment.

With reference to FIG. 3, upper briefcase structure 22 is provided with an L-shaped, thermal fabric lined hair dryer storage compartment 50 that is accessible through a flexible cover flap 52. Cover flap 52 is sealable with a zipper closure 54. With reference to FIG. 4, in this embodiment L-shaped, thermal fabric lined hair dryer storage compartment 50 is lined with cotton batting filled quilted material, such as is used in the construction of oven safety mitts, that has a non-burn coated woven fabric outer shell that faces storage compartment 50. In this embodiment, the non-burn coating is a polytetrafluorethylene coating such as is used to coat ironing board covers.

It can be seen from the preceding description that a carrying case for hair styling equipment has been provided that includes a thermal fabric lined compartment within which heat generating hair styling tools, such as blow dryers and curling irons, can be stored immediately after use; that includes storage compartments formed from an anti-bacterial plastic; and that includes a clamshell briefcase structure having hingedly connected upper and lower briefcase sections, the lower briefcase section having an open topped cavity formed therein that is sealed when the upper and lower briefcase sections are pivoted together and an open sided tray storage compartment having a side opening in connection with the exterior of the lower briefcase section, the upper briefcase section having an exteriorly positioned cover flap affixable in a closed position by a zipper closure, the cover flap covering a hair dryer insertion opening formed in connection with an L-shaped, thermal fabric lined hair dryer storage compartment formed within the upper briefcase section; an accordion fold upper storage compartment member affixed to an interior surface of the upper briefcase section, the accordion fold upper storage compartment member being foldable out to form an accordion fold compartment, the accordion fold upper storage compartment member including a first plurality of storage pockets formed on a surface thereof; a drop-in, molded, anti-bacterial plastic storage insert sized to drop-in fit into the open topped cavity of the lower briefcase section, the storage insert including a second plurality of storage insert cavities formed therein; and a slide-in, molded, anti-bacterial plastic storage tray that is sized to slide into the side opening of the open sided tray storage compartment, the storage tray having a third plurality of storage tray cavities formed therein.

It is noted that the embodiment of the carrying case for hair styling equipment described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A carrying case for hair styling equipment comprising:

a clamshell briefcase structure having hingedly connected upper and lower briefcase sections, said lower briefcase section having an open topped cavity formed therein that is sealed when said upper and lower briefcase sections are pivoted together, said upper briefcase section having an exteriorly positioned cover flap affixable in a closed position by a zipper closure, said cover flap covering a hair dryer insertion opening formed in connection with thermal fabric lined hair dryer storage compartment formed within said upper briefcase section; and a drop-in storage insert sized to drop-in fit into said open topped cavity of said lower briefcase section, said storage insert including a second plurality of storage insert cavities formed therein;

said thermal fabric being a batting filled quilted material having a non-burn coating coated woven fabric outer shell, said non-burn coating being a polytetrafluorethylene coating.

2. The carrying case for hair styling equipment of claim 1 wherein:

said thermal fabric lined hair dryer storage compartment is L-shaped.

3. The carrying case for hair styling equipment of claim 2 wherein:

said drop-in storage insert is constructed from an anti-bacterial plastic.

4. The carrying case for hair styling equipment of claim 2, further including:

an accordion fold upper storage compartment member affixed to an interior surface of said upper briefcase section, said accordion fold upper storage compartment member being foldable out to form an accordion fold compartment.

5. The carrying case for hair styling equipment of claim 4 wherein:

said accordion fold upper storage compartment member includes a first plurality of storage pockets formed on a surface thereof.

6. The carrying case for hair styling equipment of claim 2, wherein:

said lower briefcase section includes an open sided tray storage compartment having a side opening in connection with said exterior of said lower briefcase section; and said carrying case further includes:

slide-in storage tray that is sized to slide into said side opening of said open sided tray storage compartment, said storage tray having a third plurality of storage tray cavities formed therein.

7. The carrying case for hair styling equipment of claim 6, wherein:

said slide-in storage tray is constructed of anti-bacterial plastic.

8. The carrying case for hair styling equipment of claim 1 wherein:

said drop-in storage insert is constructed from an anti-bacterial plastic.

9. The carrying case for hair styling equipment of claim 8, further including:

an accordion fold upper storage compartment member affixed to an interior surface of said upper briefcase section, said accordion fold upper storage compartment member being foldable out to form an accordion fold compartment.

10. The carrying case for hair styling equipment of claim 9 wherein:

said accordion fold upper storage compartment member includes a first plurality of storage pockets formed on a surface thereof.

11. The carrying case for hair styling equipment of claim 8, wherein:

said lower briefcase section includes an open sided tray storage compartment having a side opening in connection with said exterior of said lower briefcase section; and said carrying case further includes:

a slide-in storage tray that is sized to slide into said side opening of said open sided tray storage compartment, said storage tray having a third plurality of storage tray cavities formed therein.

12. The carrying case for hair styling equipment of claim 11, wherein:

said slide-in storage tray is constructed of anti-bacterial plastic.

13. The carrying case for hair styling equipment of claim 1, further including:

an accordion fold upper storage compartment member affixed to an interior surface of said upper briefcase section, said accordion fold upper storage compartment member being foldable out to form an accordion fold compartment.

14. The carrying case for hair styling equipment of claim 13 wherein:

said accordion fold upper storage compartment member includes a first plurality of storage pockets formed on a surface thereof.

15. The carrying case for hair styling equipment of claim 13, wherein:

said lower briefcase section includes an open sided tray storage compartment having a side opening in connection with said exterior of said lower briefcase section; and said carrying case further includes:

a slide-in storage tray that is sized to slide into said side opening of said open sided tray storage compartment, said storage tray having a third plurality of storage tray cavities formed therein.

16. The carrying case for hair styling equipment of claim 15, wherein:

said slide-in storage tray is constructed of anti-bacterial plastic.

17. The carrying case for hair styling equipment of claim 1, wherein:

said lower briefcase section includes an open sided tray storage compartment having a side opening in connection with said exterior of said lower briefcase section; and said carrying case further includes:

a slide-in storage tray that is sized to slide into said side opening of said open sided tray storage compartment, said storage tray having a third plurality of storage tray cavities formed therein.

18. The carrying case for hair styling equipment of claim 17 wherein:

said slide-in storage tray is constructed of anti-bacterial plastic.

* * * * *